US010889477B2

(12) United States Patent
Urff

(10) Patent No.: US 10,889,477 B2
(45) Date of Patent: Jan. 12, 2021

(54) INFLATABLE AIR WEDGE WITH TOOL CHANNEL AND ASSOCIATED METHOD

(71) Applicant: Bruce Urff, Jacksonville, FL (US)

(72) Inventor: Bruce Urff, Jacksonville, FL (US)

(73) Assignee: Xtreme Air Wedge, LLC, Jacksonville, FL (US)

( * ) Notice: Subject to any disclaimer, the term of this patent is extended or adjusted under 35 U.S.C. 154(b) by 0 days.

(21) Appl. No.: 15/951,395

(22) Filed: Apr. 12, 2018

(65) Prior Publication Data

US 2018/0229985 A1 Aug. 16, 2018

Related U.S. Application Data

(60) Provisional application No. 62/484,783, filed on Apr. 12, 2017.

(51) Int. Cl.

| | |
|---|---|
| ***B66F 3/35*** | (2006.01) |
| ***B66F 3/24*** | (2006.01) |
| ***E05B 19/20*** | (2006.01) |
| ***E05B 85/08*** | (2014.01) |
| ***A62B 3/00*** | (2006.01) |

(52) U.S. Cl.

CPC ..... *B66F 3/35* (2013.01); *A62B 3/005* (2013.01); *E05B 19/20* (2013.01); *B66F 3/247* (2013.01); *E05B 85/085* (2013.01)

(58) Field of Classification Search

CPC ..... B66F 3/35; B66F 3/247; E05B 19/20
USPC ..... 254/93 HP
See application file for complete search history.

(56) References Cited

U.S. PATENT DOCUMENTS 1,752,101 A * 3/1930 Meutsch ..... E21D 15/445 248/354.1
2,480,477 A * 8/1949 Jones ..... E04G 19/00 425/470
3,822,861 A * 7/1974 Scott ..... E04G 19/00 254/93 HP
4,222,549 A * 9/1980 Lindgren ..... A01G 23/099 254/93 HP (Continued)

OTHER PUBLICATIONS

New 2 in 1 Air Wedge Car Door Opening Tool (Big) <http://www.uobdii.com/wholesale/2-in-1-air-wedge-car-door-opening-tool-big.html>.*

(Continued)

*Primary Examiner* — Lee D Wilson
*Assistant Examiner* — Seahee Hong
(74) *Attorney, Agent, or Firm* — Ashkan Najafi

(57) ABSTRACT

An inflatable air wedge has a tool channel that is inserted between a vehicle door and a vehicle body for allowing an operator to effectively unlock the vehicle door without damaging the vehicle (door and/or body and/or weather stripping). The inflatable air wedge includes a selectively inflatable bladder capable of being intercalated between the existing vehicle door and the existing vehicle body, a pneumatic mechanism in operable communication with the bladder for selectively introducing and releasing air from the bladder, and a conduit engaged with the bladder. Advantageously, such a conduit is suitably sized and shaped for guiding an existing unlocking tool therethrough while the bladder is at an inflated state and seated between the vehicle door and the vehicle body. Notably, the conduit is spaced from the pneumatic mechanism and manually distended when the unlocking tool is positioned therein.

2 Claims, 11 Drawing Sheets

(56) References Cited

U.S. PATENT DOCUMENTS

| | | | | |
|---|---|---|---|---|
| 4,433,463 | A * | 2/1984 | DuVal | B25B 27/02 254/104 |
| 4,443,001 | A | 4/1984 | Haerer | |
| 4,833,767 | A | 5/1989 | Parkins | |
| 5,104,094 | A | 4/1992 | Womack | |
| 6,298,539 | B1 * | 10/2001 | Dissing | E05B 19/20 254/93 HP |
| 8,151,470 | B2 * | 4/2012 | Hallman | B60S 3/045 30/167 |
| 8,215,615 | B2 | 7/2012 | Niklasson | |
| 9,422,735 | B1 | 8/2016 | Asplin | |
| 2008/0121285 | A1 * | 5/2008 | Weinel | B66F 3/35 137/223 |
| 2008/0210917 | A1 * | 9/2008 | Niklasson | B66F 3/35 254/93 HP |
| 2012/0286223 | A1 * | 11/2012 | Vigil | B66F 3/247 254/93 HP |
| 2016/0325971 | A1 * | 11/2016 | Dissing | B66F 3/35 |

OTHER PUBLICATIONS

Keymam New 2 in 1 Air Wedge Car door Opening Tool (big)—Wayback Machine <https://web.archive.org/web/20160128071817/http://keymam.com/product_view.asp?pid=3332>.*

Lee W. Young, International Search Report and Written Opinion of the International Searching Authority (US), dated Jun. 28, 2018, 22 pages.

* cited by examiner

INFLATABLE AIR WEDGE WITH TOOL CHANNEL AND ASSOCIATED METHOD

CROSS REFERENCE TO RELATED APPLICATIONS

This is a non-provisional patent application that claims the benefit of U.S. provisional patent application No. 62/484,783 filed Apr. 12, 2017, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to inflatable wedges that permit keyless entry to locked vehicles and, more particularly, to an inflatable air wedge having a tool channel that is inserted between a vehicle door and a vehicle body for allowing an operator to effectively unlock the vehicle door without damaging the vehicle.

Prior Art

Many occasions exist in which legal entry into a locked vehicle (or truck), without the use of a key to the vehicle and without damage to the vehicle, is desired or necessary. It is, for example, a common occurrence for drivers to lock themselves out of their vehicles by inadvertently locking all the doors—with the windows closed—with the entry key either still in the ignition switch or elsewhere in the vehicle. In other instances, locked and illegally-parked vehicles may have to be entered by police or tow truck operators to enable the vehicle to be towed away. In still other instances, it may be necessary for legal authorities to enter locked vehicles to make legal searches for contraband or explosives, to investigate crimes or, in some cases, to enable the vehicles to be moved out of the way of other vehicles in the case of emergencies and natural disasters.

Although vehicle master keys may be available to police departments and other authorized agencies, key sets sufficient for entry into all types and models of vehicles are numerous and expensive and are, therefore, not generally made available to ordinary tow truck operators, locksmiths, fire departments, or security personnel who most commonly are faced with the day-to-day problems of entering locked vehicles. Although, in emergency situations, vehicle windows can be broken to enable unlocking of vehicles from the inside, such means for entry obviously necessitate the replacement of the broken window, often at considerable expense, and may otherwise subject the individual, company, or agency which was responsible for the damage to legal action by the vehicle owner.

It has, however, long been known by police, tow truck operators, locksmiths, and others whose occupations frequently require legal entry into locked vehicles that vehicle door locking linkages inside vehicle doors can often be manipulated by a person outside the vehicle in a manner which will unlock the door. A common tool for such door unlocking linkage manipulation is a slender, flat strip of metal with a notch cut in one end. Such a tool, which is frequently referred to as a "Slim Jim", is slipped downwardly along a closed window into a locked door and is manipulated by the operator until the hooked end of the strip catches some part of the lock linkage, usually a longitudinally, extending link. When the metal strip has engaged the lock linkage in such a manner, an upward pull or downward push on the strip (Slim Jim) is generally all that is needed to move the linkage sufficiently to unlock the door. Furthermore, many newer vehicles employ door airbags that prematurely explode when a "Slim Jim" is inserted into the door. As can be readily appreciated, such operation from outside a vehicle with locked doors and closed windows is an extremely difficult task to accomplish, especially if it is desired or necessary not to damage the vehicle in any manner.

Accordingly, a need remains for an inflatable wedge having a tool channel in order to overcome at least one aforementioned shortcoming. The exemplary embodiment(s) satisfy such a need by providing an inflatable air wedge having a tool channel that is inserted between a vehicle door and a vehicle body that is convenient and easy to use, lightweight yet durable in design, versatile in its applications, and designed for allowing an operator to effectively unlock the vehicle door without damaging the vehicle.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide an inflatable air wedge having a tool channel that is inserted between a vehicle door and a vehicle body for allowing an operator to effectively unlock the vehicle door without damaging the vehicle. These and other objects, features, and advantages of the non-limiting exemplary embodiment(s) are provided by an inflatable air wedge for allowing an operator to efficiently unlock an existing door of a vehicle without damaging an existing body and/or door of the vehicle. The inflatable air wedge includes a selectively inflatable bladder capable of being intercalated between the existing vehicle door and the existing vehicle body, a pneumatic mechanism in operable communication with the bladder for selectively introducing and releasing air from the bladder, and a conduit engaged with the bladder. Advantageously, such a conduit is suitably sized and shaped for guiding an existing unlocking tool therethrough while the bladder is at an inflated state and seated between the vehicle door and the vehicle body. Notably, the conduit is spaced from the pneumatic mechanism and manually distended when the unlocking tool is positioned therein.

In a non-limiting exemplary embodiment, the conduit is located exterior of the bladder.

In a non-limiting exemplary embodiment, the conduit is located interior of the bladder.

In a non-limiting exemplary embodiment, the conduit is a rectilinear channel having a proximal open end and a distal open end axially opposed therefrom.

In a non-limiting exemplary embodiment, the proximal open end is located at a first side of the bladder, and the distal open end is located at a second side of the bladder, wherein the first side is situated opposite to the second side.

In a non-limiting exemplary embodiment, the pneumatic mechanism is a manual pump disposed exterior of the bladder.

In a non-limiting exemplary embodiment, the conduit is statically affixed to an outer surface of the bladder.

In a non-limiting exemplary embodiment, the conduit bifurcates the bladder into a first portion and a second portion in fluid communication with the first portion.

In a non-limiting exemplary embodiment, a flexible insert is located within the bladder and spanning along a major interior surface area of the bladder, the flexible insert being pliable and generally resilient.

The present disclosure further includes a method of utilizing an inflatable air wedge for allowing an operator to efficiently unlock an existing door of a vehicle without damaging the existing body and/or door of the vehicle. Such a method includes the steps of: providing a selectively inflatable bladder; providing a pneumatic mechanism in operable communication with the bladder; providing a conduit engaged with the bladder wherein the conduit being spaced from the pneumatic mechanism; providing an unlocking tool; intercalating the selectively inflatable bladder between the existing vehicle door and the existing vehicle body; the pneumatic mechanism selectively introducing air into the bladder; manually distending the conduit by guiding the existing unlocking tool through the conduit while the bladder is at an inflated state and seated between the vehicle door and the vehicle body; and manipulating the unlocking tool and thereby unlocking the existing vehicle door. Notably, conduit also protects the weather stripping attached to one or both of the vehicle door and body.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

FIG. 3B is an enlarged side elevational view taken along line 3B-3B in FIG. 3;

Figure 1:
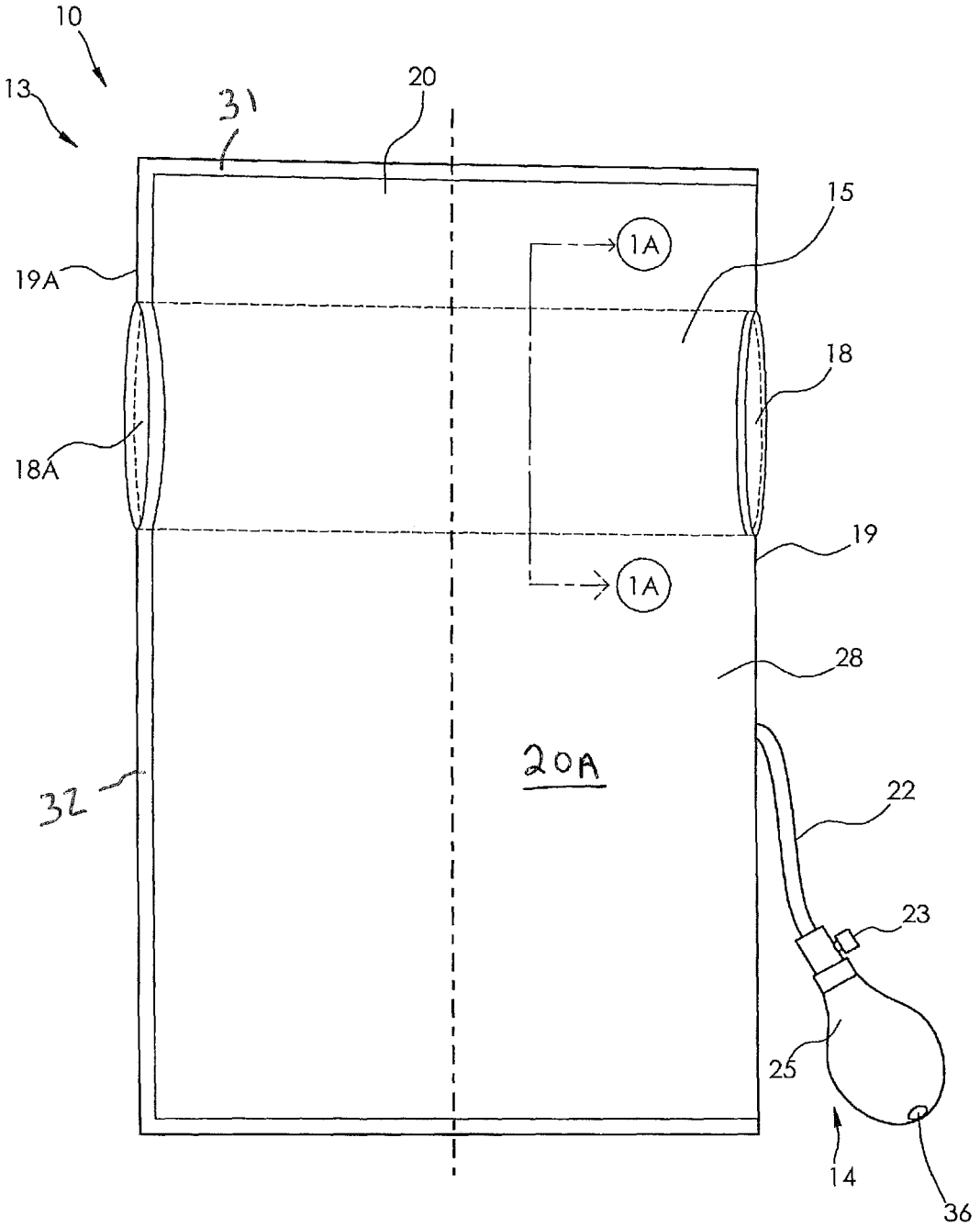
FIG. 1 is a perspective view of an inflatable air wedge having an internal tool conduit (oriented approximately 90 degrees relative to a longitudinal axis of the bladder) and having a reinforcing member disposed therein, in accordance with a non-limiting exemplary embodiment of the present disclosure.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means±15% of the numerical.

If used herein, "substantially" means largely if not wholly that which is specified but so close that the difference is insignificant.

The terms "conduit," "channel," "sleeve," and similar variations thereof are interchangeably employed throughout the present disclosure. The terms "flexible insert," "reinforcing member," and "stiffener" are interchangeably employed throughout the present disclosure.

FIG. 1 is a perspective view of an inflatable air wedge 10 having an internal tool conduit (oriented approximately 90 degrees relative to a longitudinal axis of the bladder) and having a reinforcing member disposed therein, in accordance with a non-limiting exemplary embodiment of the present disclosure.

Figure 1A:
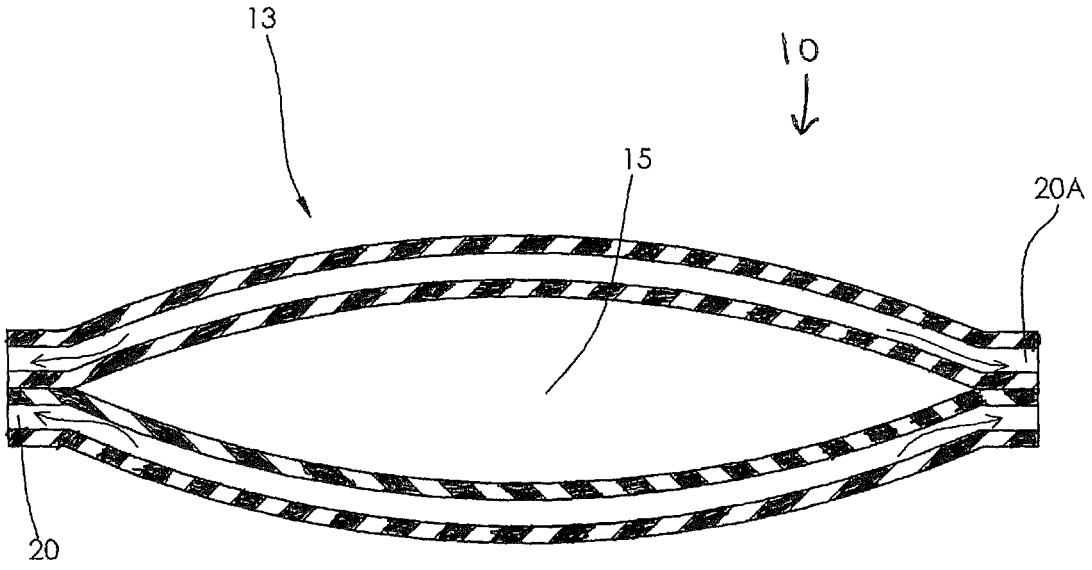
FIG. 1A is an enlarged cross-sectional view taken along line 1A-1A in FIG. 1.

FIG. 1A is an enlarged cross-sectional view taken along line 1A-1A in FIG. 1.

Figure 2B:
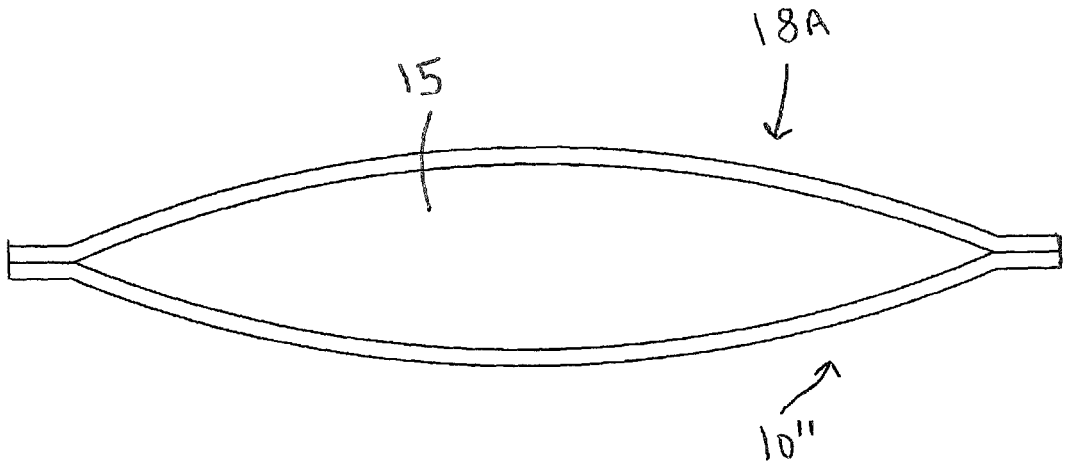
FIG. 2B is an enlarged side elevational view showing the conduit located external of the bladder.
Figure 2:
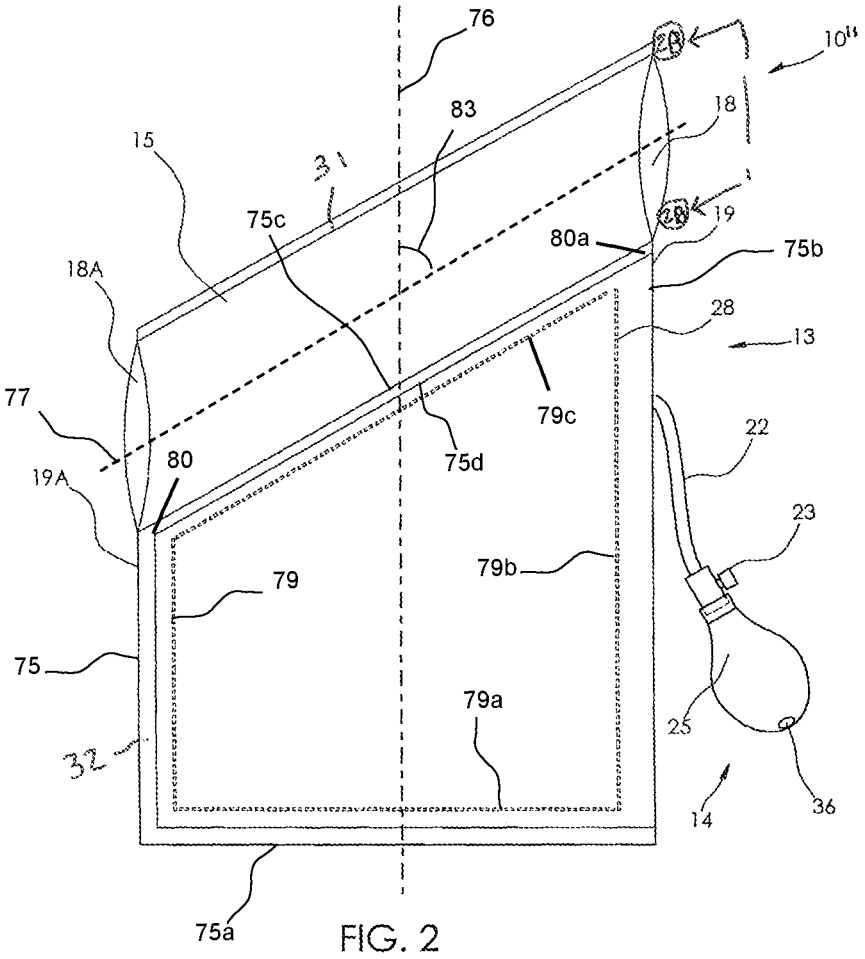
FIG. 2 is a perspective view of an inflatable air wedge having an external tool conduit (oriented approximately 45 degrees relative to a longitudinal axis of the bladder) and a reinforcing member disposed therein, in accordance with another non-limiting exemplary embodiment of the present disclosure.

FIG. 2 is a perspective view of an inflatable air wedge 10" having an external tool conduit 15 (oriented approximately 45 degrees relative to a first centrally registered longitudinal axis 76 of the bladder 13) and having a trapezoidal shaped reinforcing member disposed therein, in accordance with another non-limiting exemplary embodiment of the present disclosure. The bladder 13 has a first centrally registered longitudinal axis 76, and the conduit 15 has a second centrally registered longitudinal axis 77 angularly offset approximately 45 degrees (see reference numeral 83) from the first centrally registered longitudinal axis 76. The bladder 13 has a first plurality of peripheral edges (collectively at 75, 75*a*, 75*b*, 75*c*, 75*d*) conjoined at a first end-to-end configuration. The insert 28 has a second plurality of peripheral edges (collectively at 79, 79*a*, 79*b*, 79*c*) conjoined at a second end-to-end configuration and disposed substantially parallel to the first plurality of peripheral edges (collectively at 75, 75*a*, 75*b*, 75*c*, 75*d*), respectively. The first plurality of peripheral edges (collectively at 75, 75*a*, 75*b*, 75*c*, 75*d*) includes a first peripheral edge 75 and a second peripheral edge 75*a* equidistantly spaced apart on opposite sides of the first centrally registered longitudinal axis 76. Each of the first peripheral edge 75 and the second peripheral edge 75*a* are oriented parallel relative to the first centrally registered longitudinal axis 76 and further oriented approximately 45 degrees (see reference numeral 83) relative to the second centrally registered longitudinal axis 77. The first plurality of peripheral edges (collectively at 75, 75*a*, 75*b*, 75*c*, 75*d*) further includes a third peripheral edge 75*d* conjoined to the conduit 15. Such a third peripheral edge 75*d* is oriented approximately 45 degrees relative to the first centrally registered longitudinal axis 76 and parallel relative to the second centrally registered longitudinal axis 77. The opposed axial ends 80, 80*a* of the third peripheral edge 75*d* are abutted to the first peripheral edge 75 and the second peripheral edge 75*a*, respectively.

Figure 2A:
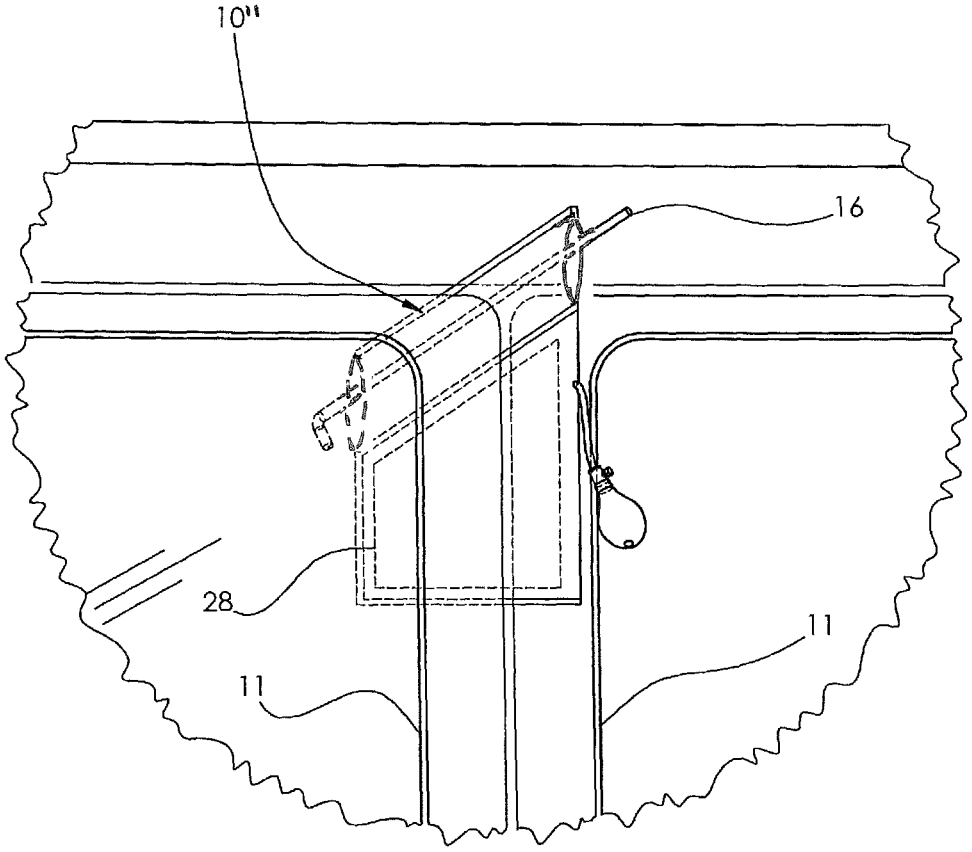
FIG. 2A is an environmental view showing the inflatable air wedge of FIG. 2 positioned between an upper corner of a vehicle door and a vehicle body with the unlocking tool passed from an exterior of the vehicle through an external tool conduit and into an interior of vehicle.

FIG. 2A is an environmental view showing the inflatable air wedge 10" of FIG. 2 positioned between an upper corner of a vehicle door and a vehicle body with the unlocking tool passed from an exterior of the vehicle through an external tool conduit and into an interior of vehicle.

FIG. 2B is an enlarged side elevational view showing the conduit 15 located external of the bladder 13.

Figure 3:
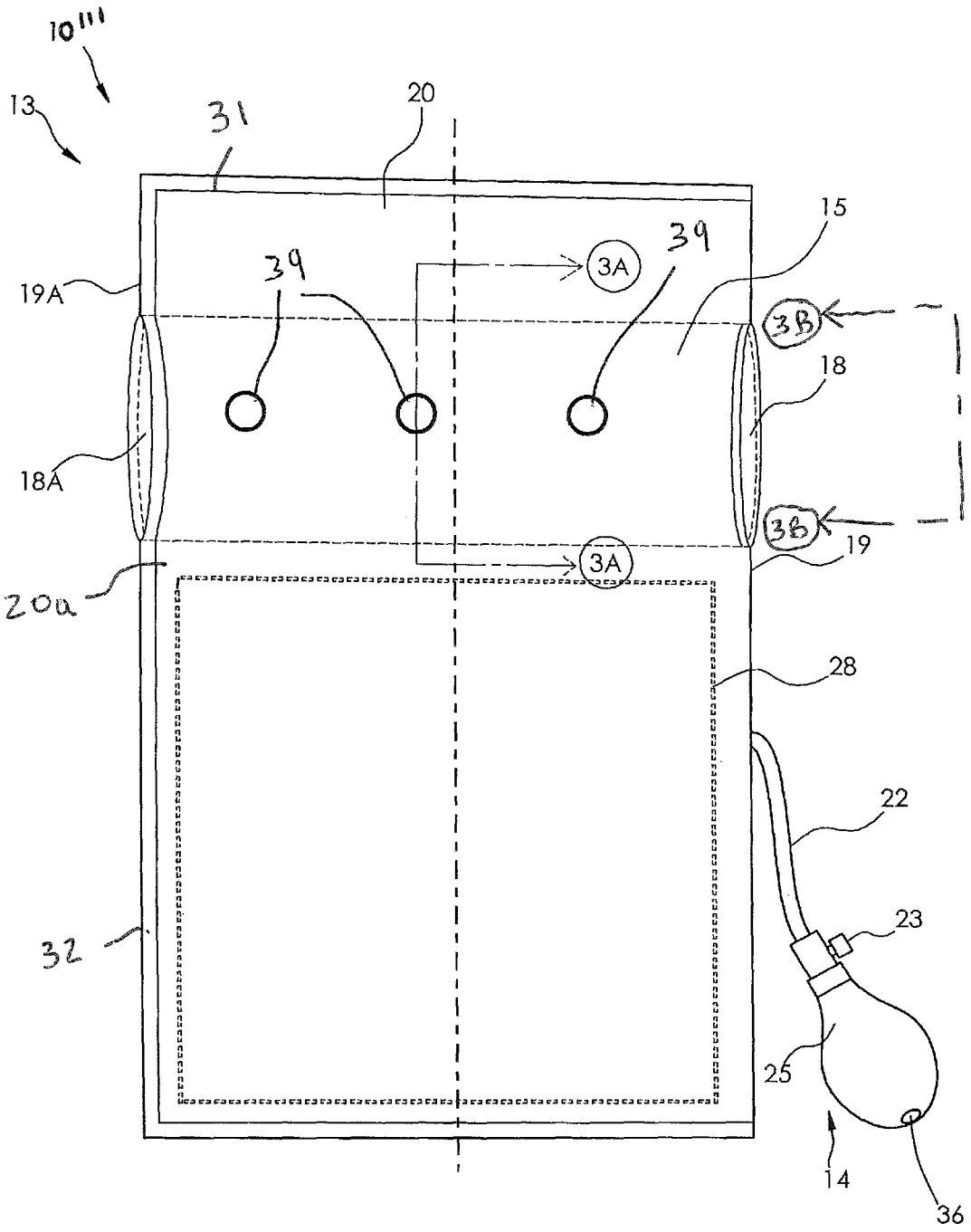
FIG. 3 is a perspective view of the inflatable air wedge, shown in FIG. 1, wherein a plurality of juxtaposed sealed tabs keep the internal tool conduit partially abutted to the bladder such that the internal tool conduit is maintained at an open and accessible position when the surrounding bladder is inflated.

FIG. 3 is a perspective view of an inflatable air wedge 10'", wherein a plurality of juxtaposed sealed tabs 39 keep the internal tool conduit 15 partially abutted to the bladder 13 such that the internal tool conduit 15 is maintained at an open and accessible position when the surrounding bladder 13 is inflated, in accordance with another non-limiting exemplary embodiment of the present disclosure.

Figure 3A:
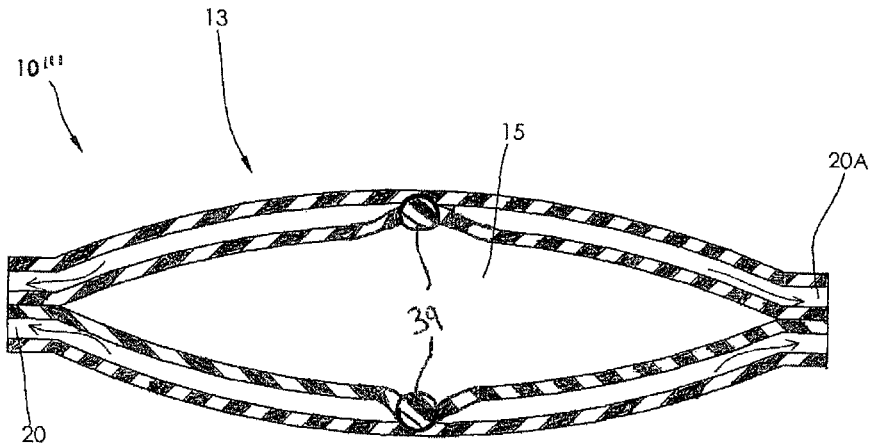
FIG. 3A is an enlarged cross-sectional view taken along line 3A-3A in FIG. 3.
Figure 38:
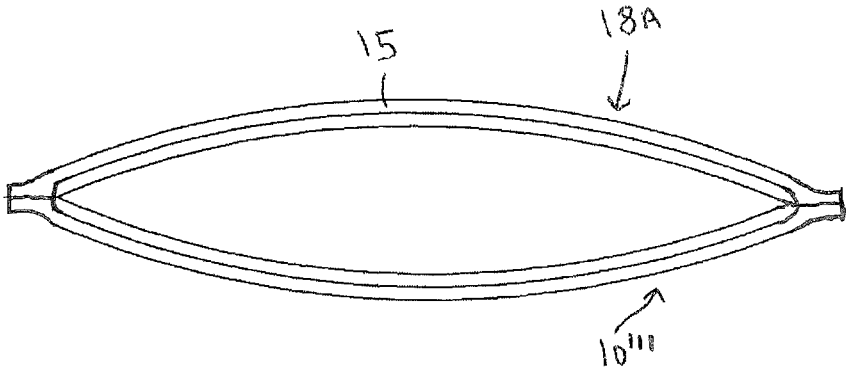

FIG. 3A is an enlarged cross-sectional view taken along line 3A-3A in FIG. 3 wherein sealed tabs 39 maintain the top and bottom sides of conduit 15 abutted or engaged with the top and bottom layers of bladder 13, respectively.

FIG. 3B is an enlarged side elevational view taken along line 3B-3B in FIG. 3 wherein ends 18, 18A of conduit 15 are heated sealed to sides 19, 19A, respectively, of bladder 13. One skilled in the art understands ends 18, 18A of conduit 15 are closed to maintain a desired air pressure inside bladder portions 20, 20A.

Figure 4:
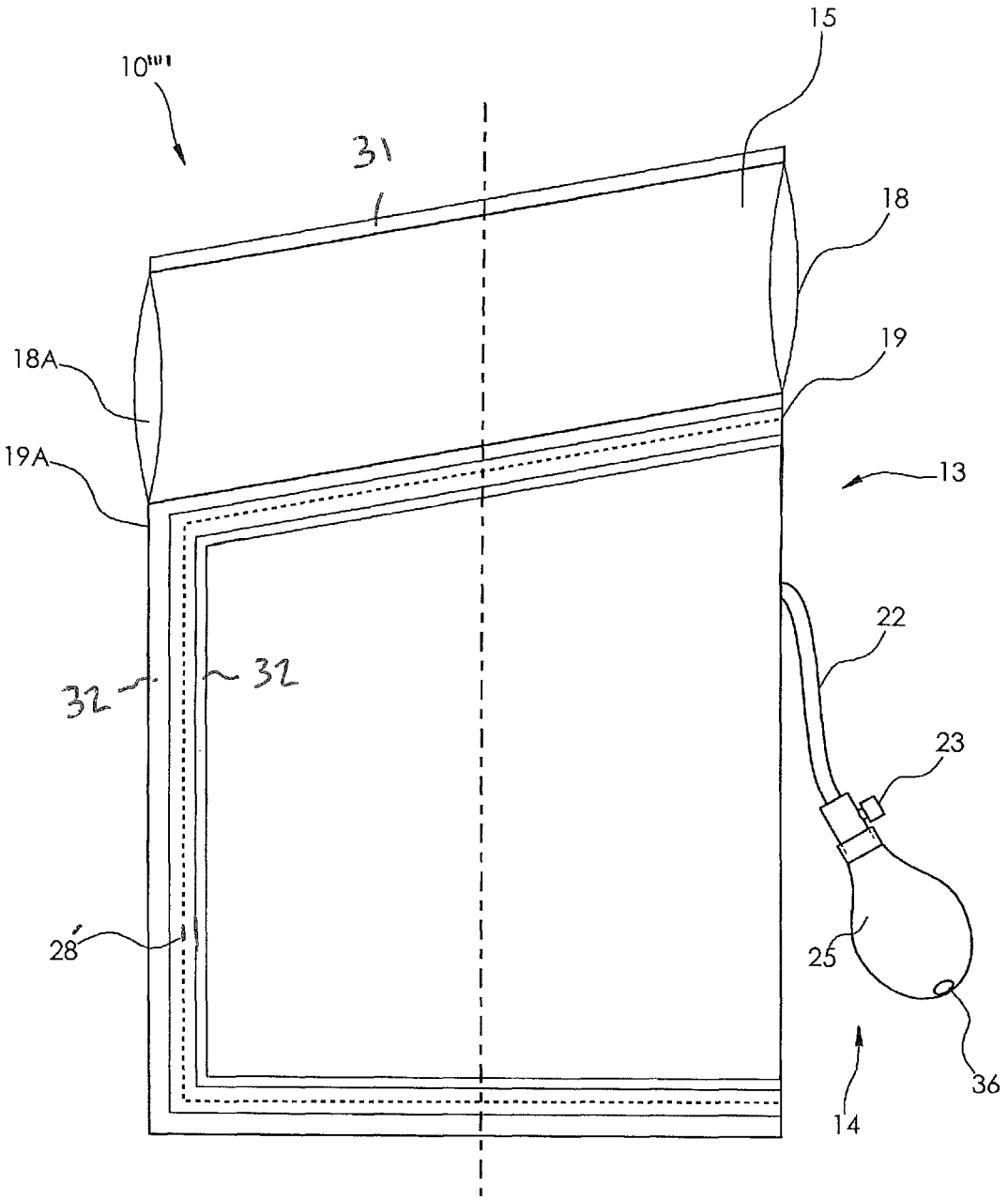
FIG. 4 is a perspective view of the inflatable air wedge, similar to the embodiment shown in FIG. 2, wherein the reinforcing member has a generally U-shape.

FIG. 4 is a perspective view of the inflatable air wedge 10"" having an external tool conduit 15 and a generally U-shaped reinforcing member 28' statically positioned within heat sealed borders 32 of bladder 13, which provides suitable rigidity for assisting a user to insert bladder 13 between a vehicle door 11 and body 12, in accordance with another non-limiting exemplary embodiment of the present disclosure.

Figure 5:
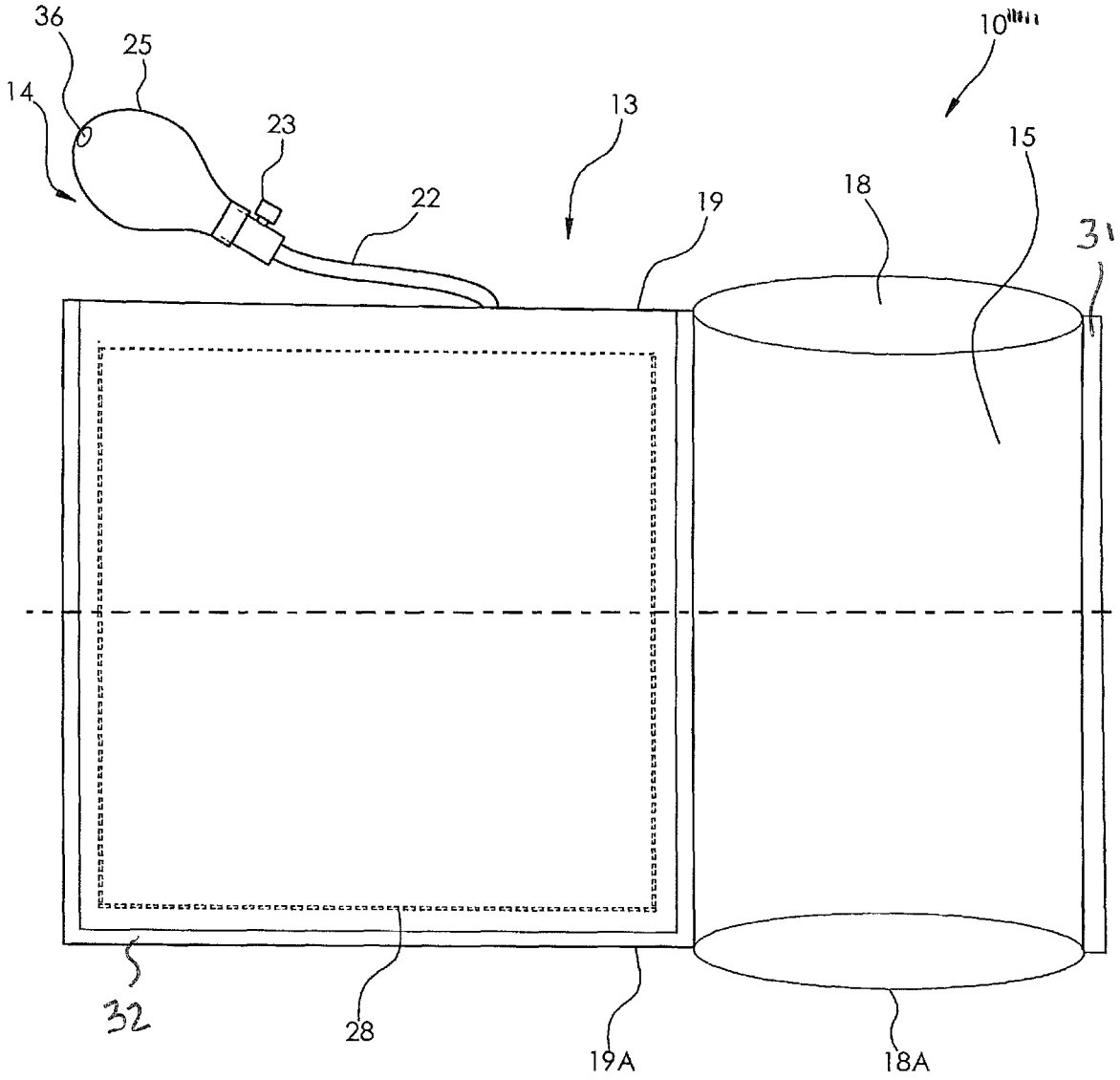
FIG. 5 is a perspective view of an inflatable air wedge having an external tool conduit (oriented approximately 90 degrees relative to a longitudinal axis of the bladder) and a substantially square, plate-shaped reinforcing member disposed therein, in accordance with a non-limiting exemplary embodiment of the present disclosure.
Figure 5A:
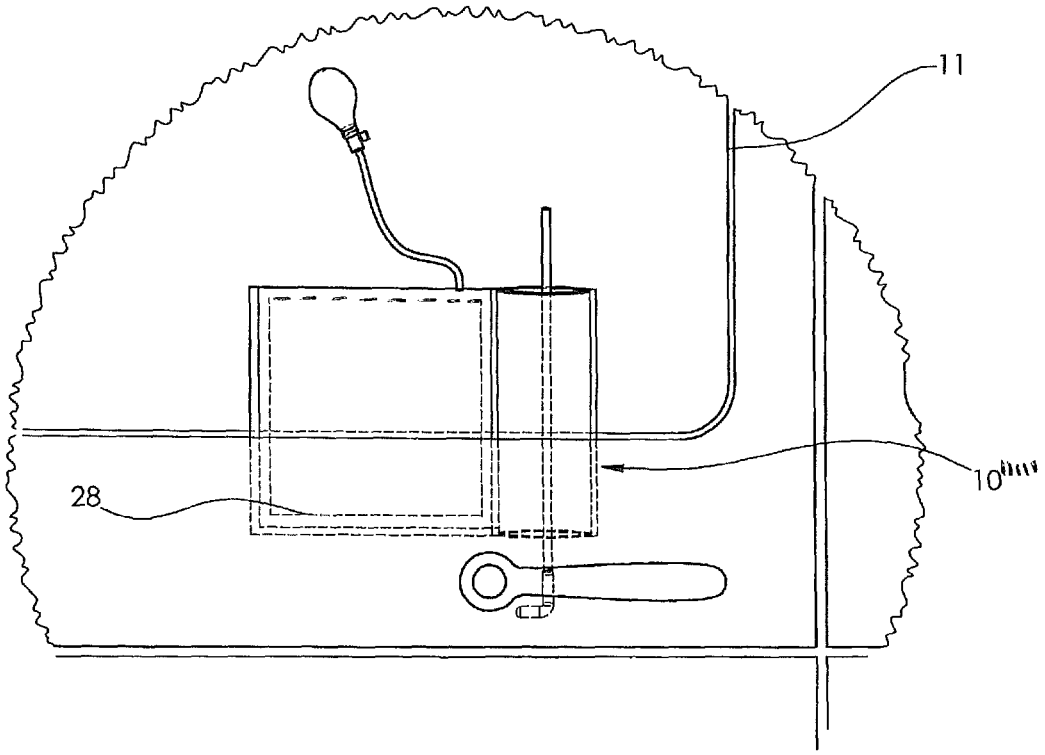
FIG. 5A is an environmental view showing the inflatable air wedge of FIG. 5 positioned between a window and a window seal of a vehicle door with the unlocking tool passed from an exterior of the vehicle through an external tool conduit and into an interior of vehicle.

FIG. 5 is a perspective view of an inflatable air wedge 10'''' having an external tool conduit 15 (oriented approximately 90 degrees relative to a longitudinal axis of the bladder) and a substantially square reinforcing member 28 (e.g., solid, pliable, and resilient insert) disposed therein, in accordance with a non-limiting exemplary embodiment of the present disclosure;

FIG. 5A is an environmental view showing the inflatable air wedge 10'''' of FIG. 5 positioned between a window and a lower window seal of a vehicle door, wherein the unlocking tool 16 is passed from an exterior of the vehicle through an external tool conduit 15 and into an interior of vehicle.

Figure 6:
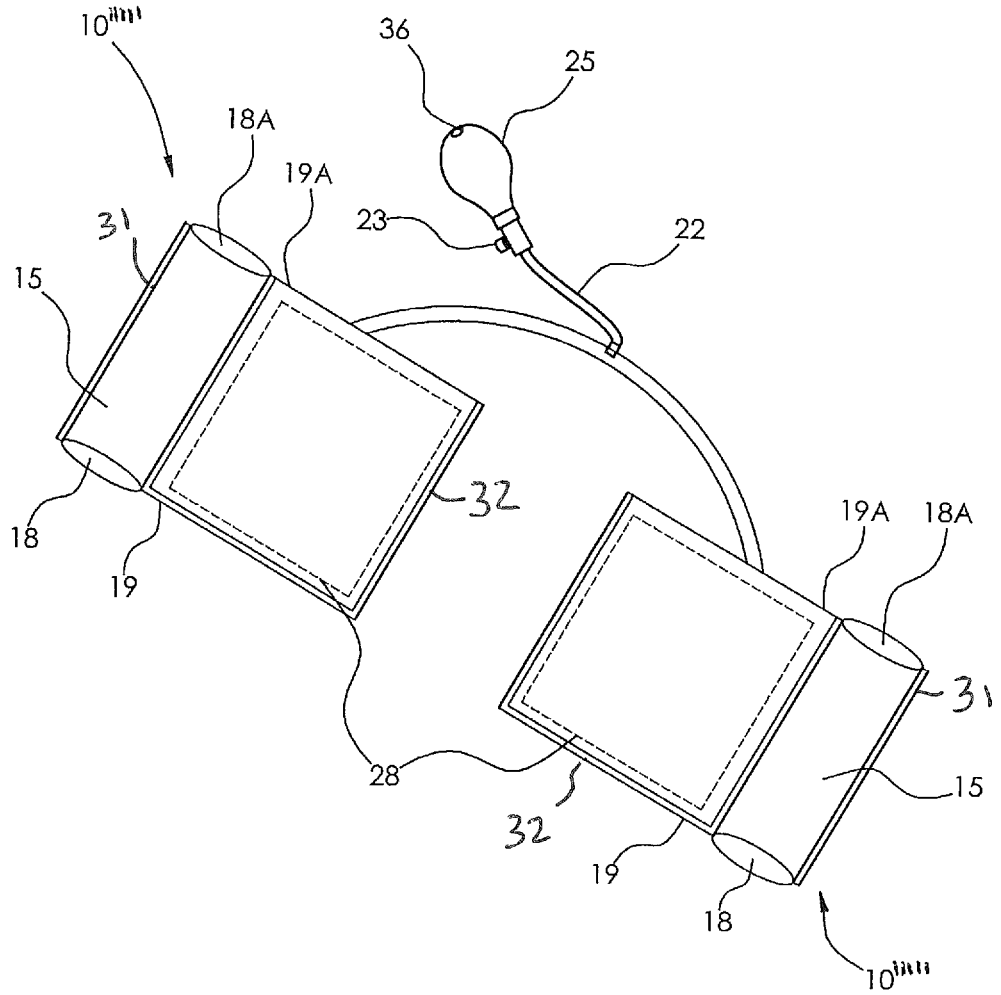
FIG. 6 is a perspective view of a pair of inflatable air wedges, shown in FIG. 5, wherein both inflatable air wedges are simultaneously inflated via a common hand-squeezed bulb, in accordance with another non-limiting exemplary embodiment of the present disclosure.

FIG. 6 is a perspective view of a pair of inflatable air wedges 10'''', shown in FIG. 5, wherein both inflatable air wedges are simultaneously inflated via a common hand-squeezed bulb 25, in accordance with another non-limiting exemplary embodiment of the present disclosure.

Figure 7:
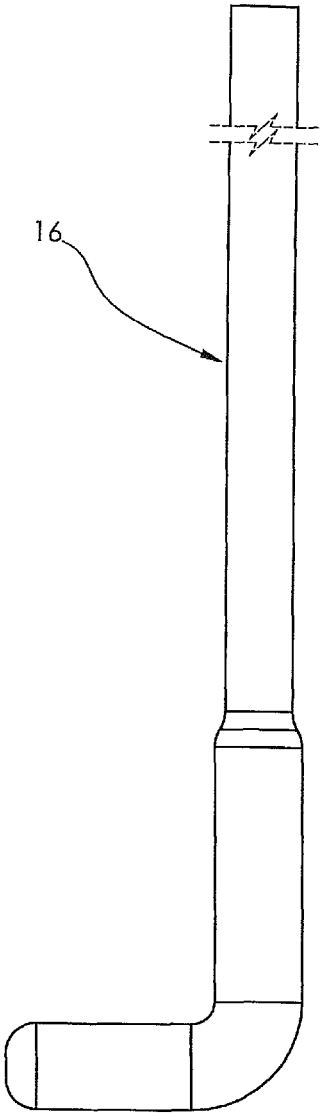
FIG. 7 is a side elevational view of a non-limiting exemplary embodiment of an unlocking tool employed by various non-limiting exemplary embodiments of the present disclosure.
Figure 7A:
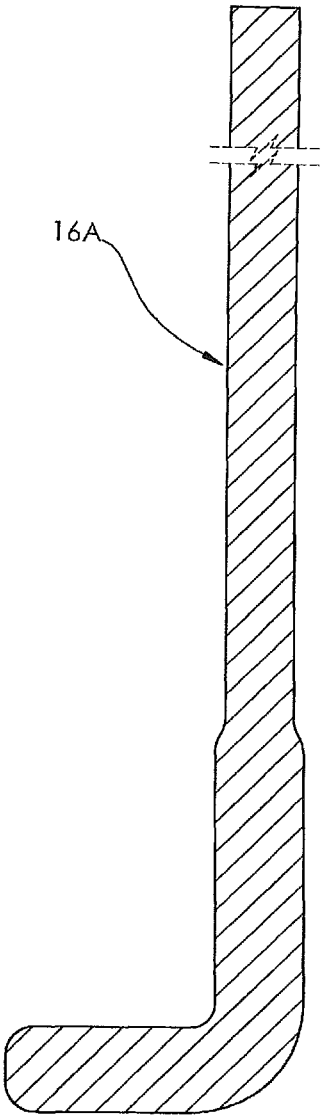
FIG. 7A is a cross-sectional view of the unlocking tool shown in FIG. 7.

FIG. 7 is a side elevational view of a non-limiting exemplary embodiment of an unlocking tool 16 employed by various non-limiting exemplary embodiments of the present disclosure; and FIG. 7A is a cross-sectional view of the unlocking tool 16 shown in FIG. 7.

Each of the non-limiting exemplary embodiments 10, 10', 10'', 10''', 10'''', and 10''''' has at least one sealed (preferably heat-sealed) border 31, 32 extended along at least one or more perimeter edges of bladder 13 and/or conduit 15.

The non-limiting exemplary embodiments are referred to generally in FIGS. 1-7A and are intended to provide an inflatable air wedge (collectively at 10, 10', 10'', 10''', 10'''', and 10''''') for allowing an operator to efficiently unlock an existing door 11 of a vehicle without damaging the existing body 12 and or door 11 of the vehicle. The inflatable air wedge 10, 10', 10'', 10''', 10'''', and 10''''' includes a selectively inflatable bladder 13 capable of being intercalated between the existing vehicle door 11 and the existing vehicle body 12, a pneumatic mechanism 14 in operable communication with the bladder 13 for selectively introducing and releasing air from the bladder 13, and a conduit 15 engaged with the bladder 13. Advantageously, such a conduit 15 is suitably sized and shaped for guiding an existing unlocking tool 16 therethrough while the bladder 13 is at an inflated state and seated between the vehicle door 11 and the vehicle body 12. Notably, the conduit 15 is spaced from the pneumatic mechanism 14 and manually distended when the unlocking tool 16 is positioned therein. Such a structural configuration provides the unexpected and unpredictable benefit of enabling a user to effectively unlock the vehicle door 11 without damaging the vehicle door 11 and/or the vehicle body 12. Notably, conduit 15 also protects the weather stripping attached to one or both of the vehicle door 11 and body 12.

In a non-limiting exemplary embodiment, the bladder 13 may be formed from a polyurethane coated (e.g., thermoplastic urethane (TPU)) nylon (e.g., ballistic-nylon, polyester-nylon, etc.) material, or from a vinyl coated polyester material (polyvinyl chloride). It is noted that the conduit 15 may be formed from similar material that forms the bladder 13. If the perimeter of the bladder 13 is heat-sealed, the preferred material includes a polyurethane coat. However, if the perimeter of the bladder 13 is not heat-sealed, the polyurethane coat is optional. Of course, one skilled in the art understands a variety of suitable materials and sealing techniques may be employed to form the bladder 13 and conduit 15 without departing from the true spirit and scope of the present disclosure.

In non-limiting exemplary embodiments 10'', 10'''', and 10''''', the conduit 15 is located exterior of the bladder 13.

In a non-limiting exemplary embodiment 10, 10', and 10''', the conduit 15 is located interior of the bladder 13.

In non-limiting exemplary embodiments 10, 10', 10'', 10''', 10'''', the conduit 15 is a rectilinear channel having a proximal open end 18 and a distal open end 18*a* axially opposed therefrom.

In non-limiting exemplary embodiments 10, 10', 10'', 10''', 10'''', the proximal open end 18 is located at a first side 19 of the bladder 13, and the distal open end 18*a* is located at a second side 19*a* of the bladder 13, wherein the first side 19 is situated opposite to the second side 19*a*.

In non-limiting exemplary embodiments 10'', 10'''', and 10''''', the conduit 15 is statically affixed to an outer surface of the bladder 13.

In a non-limiting exemplary embodiment 10, 10', and 10''', the conduit 15 bifurcates the bladder 13 into a first portion 20 and a second portion 20*a* in fluid communication with the first portion 20.

In a non-limiting exemplary embodiment 10''', a plurality of juxtaposed sealed tabs 39 may be spaced apart and affixed between the internal conduit 15 and surrounding bladder 13 to ensure the internal conduit 15 remains open for receiving rod 16 when the bladder 13 is inflated.

In non-limiting exemplary embodiments 10, 10', 10'', 10''', 10'''', and 10''''' the pneumatic mechanism 14 may be a manual pump disposed exterior of the bladder 13. Such a pneumatic mechanism 14 may provide a source of air-pressure including a hand squeezed bulb 25 and a flexible supply hose 22, so that the source of air-pressure may be moved out of the way after the bladder 13 is suitably inflated. A manual discharge valve 23 may release the air-pressure to remove the bladder 13 from the vehicle door 11 and body 12, and also allow the user to deflate the bladder 13 and return it to a stored, non-operating position. Of course, the deflated bladder 13 may be maneuvered and repositioned to a desired location between the vehicle door 11 and body 12. For example, the bladder 13 may be displaced along a perimeter of the vehicle door 11. One skilled in the art understands a user may employ a firm wedge or similar object to initially create a small gap between the vehicle door 11 and body 12, thereby providing an entry point for inserting the bladder 13 between the vehicle door 11 and body 12.

In non-limiting exemplary embodiments 10, 10', 10'', 10''', 10'''', and 10''''', the hand squeezed bulb 25 preferably has a flexible supply hose 22 for conducting pressurized gas such as air and a pressure release valve 23. The squeeze bulb 25 may be flexible and deformably resilient, and dimensioned and configured to be received in and operated by one hand of the user. The user may squeeze the squeeze bulb 25 to develop pneumatic pressure. Deformably resiliently of the squeeze bulb 25 spontaneously returns the squeeze bulb 25 to its original volume, thereby drawing in replacement air, after the user releases the squeeze bulb 25 from its compressed state. The squeeze bulb 25 may include a check valve 36 to enable pneumatic pressure to be developed in progressive cycles of squeezing and releasing the squeeze bulb 25.

In non-limiting exemplary embodiments 10, 10', 10'', 10''', 10'''', and 10''''', the pressure release valve 23 may be formed as part of the squeeze bulb 25. The pressure release valve 23, shown only representatively rather than literally as many different known valves may be utilized, is disposed to release pneumatic pressure from the inflatable bladder 13.

Of course, other sources of pneumatic pressure may be provided instead of or in addition to the squeeze bulb 25 if desired. For example, the source of pneumatic pressure may comprise a compressor, a reservoir of compressed gas, or a port which is matingly compatible with standard compressed air hoses and fittings.

It is noted that although the bladder 13 is shown prying the vehicle door 11 (FIG. 2A) away from the vehicle, in some cases, it would be possible to utilize the bladder 13 to pry a glass window pane (FIG. 5A) away from the surrounding frame formed in the vehicle door 11.

In a non-limiting exemplary embodiment, the expansible bladder 13 may be greater in length and width than in thickness, so that it may be easily inserted into a vehicle door 11 gap and may transfer pneumatic pressure over a top corner of the vehicle door 11 where it meets the vehicle body 12.

In non-limiting exemplary embodiments 10, 10', 10", 10''', 10'''', and 10''''', a flexible insert 28, 28' is located within the bladder 13 and spans within a major surface area of the bladder 13. Such a flexible insert 28, 28' may be pliable and generally resilient.

In non-limiting exemplary embodiments 10, 10', 10", 10''', 10'''', and 10'''', the flexible insert 28, 28' preferably acts as a stiffener to assist in intercalating the bladder 13 between the vehicle door 11 and body 12, without the bladder 13 ineffectually bending, warping or rolling up during insertion.

In non-limiting exemplary embodiments 10', 10", 10''', 10'''', and 10''''', the flexible insert 28, 28' (stiffener) may be disposed within bladder 13 to maintain a generally straight shape of the bladder 13 along one or both of the length and the width such that the bladder 13 may be intercalated between the vehicle door 11 and body 12 without ineffectually bending or rolling even when the bladder 13 is not inflated above ambient air pressure. Ordinarily, the bladder 13 is intercalated between the vehicle door 11 and body 12 prior to inflation, and is inflated only after suitably positioned within such an area. The stiffener 28 facilitates successful insertion of the otherwise flaccid bladder 13.

In non-limiting exemplary embodiments 10', 10", 10''', and 10''''' flexible insert 28 may include an deformably resilient member having a generally planar shape and located internally to the bladder 13, but which is biased by external force to assume non-planar configuration. The flexible insert 28 may take any of a number of forms such as a generally square or rectangular shape or any suitable shape for maintaining a desired rigidity to the bladder 13 during insertion between the vehicle door 11 and body 12.

In non-limiting exemplary embodiments 10'''', the flexible insert 28' may include a deformably resilient member having a generally U-shape and/or wire frame configuration.

It is noted that any of the embodiments 10, 10', 10", 10''', 10'''', and 10''''' may employ a reinforcing member (insert) 28, 28' or may operate without use of reinforcing member (insert) 28, 28'.

After that bladder 13 is inflated to a desired state, an unlocking tool 16 is passed through the conduit 15 and manipulated to unlock the vehicle door 11. Positioning the unlocking tool 16 through the conduit 15 advantageously shields the vehicle door 11 and body 12 from undesirable direct contact with the unlocking tool 16. Thus, the conduit 15 serves as a buffer or shield to protect the vehicle door 11 and body 12 from being scratched during use of the inflatable air wedge 10, 10', 10", 10''', 10'''', and 10'''''. Notably, conduit 15 also protects the weather stripping attached to one or both of the vehicle door 11 and body 12.

One skilled in the art understands unlocking tool 16 may be a variety of long reach tools well known in the industry. Such unlocking tools 16 have a variety of shapes and sizes that provide the ability to access a variety of alternate door latches, door locks, door handles, door lock actuator button, etc.

The present disclosure further includes a method of utilizing the inflatable air wedge 10, 10', 10", 10''', 10'''', and 10''''' for allowing an operator to efficiently unlock an existing door 11 of a vehicle without damaging an existing door 11 and/or body 12 of the vehicle. Such a method includes the steps of: providing a selectively inflatable bladder 13; providing a pneumatic mechanism 14 in operable communication with the bladder 13; providing a conduit 15 engaged with the bladder 13 wherein the conduit 15 is spaced from the pneumatic mechanism 14; providing an unlocking tool 16; intercalating the selectively inflatable bladder 13 between the existing vehicle door 11 and the existing vehicle body 12; the pneumatic mechanism 14 selectively introducing air into the bladder 13; manually distending the conduit 15 by guiding the existing unlocking tool 16 through the conduit 15 while the bladder 13 is at an inflated state and seated between the vehicle door 11 and the vehicle body 12; and manipulating the unlocking tool 16 and thereby unlocking the existing vehicle door 11. Notably, conduit 15 also protects the weather stripping attached to one or both of the vehicle door 11 and body 12.

It is emphasized that the present disclosure is intended solely for use in a lawful manner, by legally-operated tow trucks, by police and fire departments, and by locksmiths and other civil and governmental organizations, which are legally empowered and have a lawful right to enter locked vehicles with or without the vehicle owner's authorization.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. An inflatable air wedge for allowing an operator to unlock an existing door of a vehicle without damaging an existing body or the existing door of the vehicle or the associated weather stripping of the existing body and the existing door of the vehicle, said inflatable air wedge comprising: a selectively inflatable bladder capable of being intercalated between the existing vehicle door and the existing vehicle body; a pneumatic mechanism in operable communication with said bladder for selectively introducing and releasing air from said bladder; and a flexible insert located within said bladder and spanning within a major surface area of said bladder, said flexible insert being pliable and resilient; a conduit engaged with said bladder, said conduit being suitably sized and shaped for guiding an existing unlocking tool therethrough while said bladder is at an inflated state and seated between the vehicle door and the vehicle body; wherein said conduit is spaced from said pneumatic mechanism and manually distended; wherein said bladder has a first centrally registered longitudinal axis; wherein said conduit has a second centrally registered longitudinal axis angularly offset about 45 degrees from said first centrally registered longitudinal axis; wherein said bladder has a first plurality of peripheral edges conjoined at a first end-to-end configuration; wherein said insert has a second plurality of peripheral edges conjoined at a second end-to-end configuration and disposed substantially parallel to said first plurality of peripheral edges, respectively; wherein said first plurality of peripheral edges comprises a first peripheral edge and a second peripheral edge equidistantly spaced apart on opposite sides of the first centrally registered longitudinal axis, wherein each of said first peripheral edge and said second peripheral edge are oriented parallel relative to the first centrally registered longitudinal axis and further oriented approximately 45 degrees relative to the second centrally registered longitudinal axis; wherein said first plurality of peripheral edges further comprises a third peripheral edge conjoined to said conduit, wherein said third peripheral edge is oriented about 45 degrees relative to the first centrally registered longitudinal axis and parallel relative to the second centrally registered longitudinal axis; wherein opposed axial ends of said third peripheral edge are abutted to said first peripheral edge and said second peripheral edge, respectively.

2. The inflatable air wedge of claim 1, wherein said first end-to-end configuration has a substantially same shape as said second end-to-end configuration.

* * * * *